US010406064B1

(12) United States Patent
Faust

(10) Patent No.: US 10,406,064 B1
(45) Date of Patent: Sep. 10, 2019

(54) MASSAGING DEVICE

(71) Applicant: TUNE UP FITNESS WORLDWIDE, INC., Sherman Oaks, CA (US)

(72) Inventor: Robert Faust, Sherman Oaks, CA (US)

(73) Assignee: TUNE UP FITNESS WORLDWIDE, INC., Sherman Oaks, CA (US)

( * ) Notice: Subject to any disclaimer, the term of this patent is extended or adjusted under 35 U.S.C. 154(b) by 0 days.

(21) Appl. No.: 16/205,237

(22) Filed: Nov. 30, 2018

(51) Int. Cl.
*A61H 15/00* (2006.01)

(52) U.S. Cl.
CPC ..... *A61H 15/00* (2013.01); *A61H 2015/005* (2013.01); *A61H 2201/1253* (2013.01); *A61H 2203/0431* (2013.01); *A61H 2205/081* (2013.01)

(58) Field of Classification Search
CPC ..... A61H 15/00–02; A61H 39/00–06; A61H 2201/1253; A61H 2201/1623; A61H 2203/0431; A61H 2203/0456; A61H 2205/081; A61H 11/00
See application file for complete search history.

(56) References Cited

U.S. PATENT DOCUMENTS 3,710,785 A 1/1973 Hilger
4,154,232 A 5/1979 Fukazawa
4,576,149 A 3/1986 Otuka et al.
7,087,029 B2 8/2006 Friedland
2002/0183668 A1 12/2002 Huang
2008/0287842 A1* 11/2008 Benson-Gorelick ..... A61H 15/00 601/134
2013/0023807 A1 1/2013 Hennessey
2013/0085426 A1* 4/2013 Brodsky ..... A61H 15/00 601/128
2018/0116901 A1* 5/2018 Brisendine ..... A61H 7/005

* cited by examiner

*Primary Examiner* — Rachel T Sippel
(74) *Attorney, Agent, or Firm* — Kanika Radhakrishnan; Evergreen Valley Law Group

(57) ABSTRACT

The present disclosure provides a massaging device. The massaging device includes a plurality of massaging implements and at least one sleeve member adapted to encompass the plurality of massaging implements and forms an abutting configuration. Further, a housing member is configured to engage a massaging area on a user. The housing member is adapted to enclose the sleeve member encompassing the massaging implements, wherein each of the member is aligned along an internal axis of the housing member. The housing member ensures that massaging implements in the sleeve member is adapted to roll along a direction perpendicular to the internal axis and resist rolling along the direction of the internal axis upon application of a force during a massaging event. The device provides a stable platform for the user, thereby mitigating manual intervention of the user for holding the device during the massaging event.

13 Claims, 22 Drawing Sheets

MASSAGING DEVICE

TECHNICAL FIELD

The present disclosure generally relates to a massaging device, and more particularly relates to, a massaging device configured to provide a stable platform for a user during a massaging event.

BACKGROUND

The art of massage has long been used for relieving ailment of connective tissues on strained body parts such as but not limited to backs, shoulders, arms and legs. The massaging of the strained body parts, for example, may impart a modification to the connective tissues for diminishing the ailment, while also improving health of the connective tissues. The massage on the strained body parts may also help in effusing waste materials from the connective tissues and improve blood circulation therein, to further supplement health improvement of the connective tissues. Accordingly, numerous massaging devices are known in the art for massaging the strained body parts.

One such type of massaging device is a massaging ball. The massaging ball may be positioned between the strained body part and a firm surface. As an example, for accessing a user's back muscles, the user may lie down on the floor facing upwards and may position the massaging ball under the user's back, while lifting hips and balancing the user's bodyweight on his limbs. In this scenario, the massaging ball being compressed by the user's body weight, applies a pressure force on the user's back, for relieving the strained body part.

However, the aforementioned technique requires from the user a substantial amount of balance, strength and co-ordination for manipulating the user's bodyweight. Moreover, the device requires a substantial amount of mental concentration for manipulating the user's bodyweight, so that the massaging ball remains in the desired location. Additionally, the massaging ball may apply force equivalent to the weight of the user, which may be an excessive pressure resulting in nerve damage or bruised muscle and myofascial tissue. Furthermore, the massaging ball is typically spherical in shape, which requires a support from the user's hand for maintaining position of the massaging ball during the massaging event. Supporting the massaging ball during the massaging event may not be feasible in all occasions, particularly while trying to relocate the massaging ball to another strained body part.

In light of the foregoing discussion, a massaging device is required which can overcome the limitations stated above.

The information disclosed in this background of the disclosure section is only for enhancement of understanding of the general background of the invention and should not be taken as an acknowledgment that this information forms the prior art already known to a person skilled in the art.

SUMMARY

Various embodiments of the present disclosure provide a massaging device. The present disclosure provides the massaging device configured with a modular configuration.

In an embodiment of the present disclosure, a massaging device is disclosed. The massaging device includes a plurality of massaging implements and at least one sleeve member adapted to encompass the plurality of massaging implements. Each of the at least one sleeve member is adapted to enclose at least two massaging implements of the plurality of massaging implements aligned in an abutting configuration. Further, a housing member is configured to engage a massaging area on a user. The housing member is adapted to enclose the plurality of massaging implements encompassed within the at least one sleeve member, wherein each of the at least one sleeve member is aligned along an internal axis of the housing member. The housing member ensures that the plurality of massaging implements in the at least one sleeve member is adapted to roll along a direction perpendicular to the internal axis and resist rolling along the direction of the internal axis upon application of a force such as by the user on the housing member during a massaging event on the massaging area.

In an embodiment, each of the at least one sleeve member includes an open end for receiving the plurality of massaging implements and a closed end for retaining the plurality of massaging implements therein.

In an embodiment, one massaging implement of the at least two massaging implements contacts with another massaging implement of the at least two massaging implements within each of the at least one sleeve member to form the abutting configuration.

In an embodiment, the at least two massaging implements in each of the at least one sleeve member align parallelly along a longitudinal axis of each of the at least one sleeve member.

In an embodiment, the housing member includes at least one aperture for receiving the at least one sleeve member.

In an embodiment, the internal axis is an axis of the housing member parallel to an axial plane of one of the at least one aperture.

In an embodiment, each of the at least one sleeve member is aligned parallelly along the internal axis of the housing member, to form either of a two-dimensional configuration or a three-dimensional configuration of the plurality of massaging implements.

In an embodiment, the housing member and the at least one sleeve member are comprised of a flexible fabric material.

In an embodiment, the plurality of massaging implements comprises a plurality of spherical massaging implements, comprised of a flexible material.

In an embodiment, a boundary surface of the plurality of massaging implements project outwardly from the housing member as a protrusion, for accessing each of the plurality of massaging implements for dismantling the massaging device.

In an embodiment, the housing member includes at least one adjustable strap member mountable on a seat member, for configuring the massaging device as a lumbar support device.

In an embodiment, at least one adjustable strap member extending from the housing member is provided. The at least one adjustable strap member is mountable on a back-rest member of a seat for providing lumbar support to the user resting on the back-rest member.

In another embodiment of the present disclosure, the massaging device is provided. The massaging device comprises a plurality of massaging implements and at least one housing member configured to engage a massaging area on a user. The housing member is adapted to encompass the plurality of massaging implements, wherein each of the at least one housing member is adapted to enclose at least two massaging implements of the plurality of massaging implements in an abutting configuration and align along an internal axis of each of the at least one housing member. The plurality of massaging implements in the at least one housing member are adapted to roll along a direction lateral to the internal axis and resist rolling along the direction of the internal axis upon application of a force on the housing member during a massaging event on the massaging area In an embodiment, the plurality of massaging implements comprises a plurality of unitary massaging implements.

In an embodiment, each of the plurality of unitary massaging implements is formed by connecting at least two massaging implements of the plurality of massaging implements in the abutting configuration, by a connecting member.

In an embodiment, each of the at least two massaging implements of each of the plurality of unitary massaging implements includes a cavity for receiving one end of the connecting member, for connecting the at least two massaging implements in the abutting configuration.

In an embodiment, each of the housing member encloses at least two unitary massaging implements aligned along the internal axis.

In an embodiment, at least one sleeve member is aligned along the internal axis and enclosed within the housing member, wherein each of the at least one sleeve member encompasses at least two massaging implements of the plurality of massaging implements.

In an embodiment, the at least one housing member comprises an elastic material configured for encompassing the plurality of massaging implements.

In another embodiment, the massaging device is provided. The massaging device includes a plurality of spherical massaging implements made of a flexible material and at least one sleeve member. The at least one sleeve member is adapted to encompass the plurality of spherical massaging implements, wherein each of the at least one sleeve member is adapted to enclose at least two spherical massaging implements of the plurality of spherical massaging implements aligned in an abutting configuration. The at least one sleeve member also includes an open end for receiving the plurality of spherical massaging implements and a closed end for retaining the plurality of spherical massaging implements therein. Further, a housing member is configured to engage a massaging area on a user and includes at least one aperture for receiving each of the at least one sleeve member. The housing member is adapted to enclose the plurality of spherical massaging implements encompassed within the at least one sleeve member, wherein each of the at least one sleeve member is aligned along an internal axis of the housing member. The housing member ensures that the plurality of spherical massaging implements in the at least one sleeve member is adapted to roll along a direction perpendicular to the internal axis and resist rolling along the direction of the internal axis upon application of a force on the housing member during a massaging event on the massaging area.

BRIEF DESCRIPTION OF THE ACCOMPANYING DRAWINGS

The disclosure itself, together with further features and advantages, will become apparent from consideration of the following detailed description, taken in conjunction with the accompanying drawings. One or more embodiments of the present disclosure are now described, by way of example only wherein like reference numerals represent like elements and in which.

Figure 1:
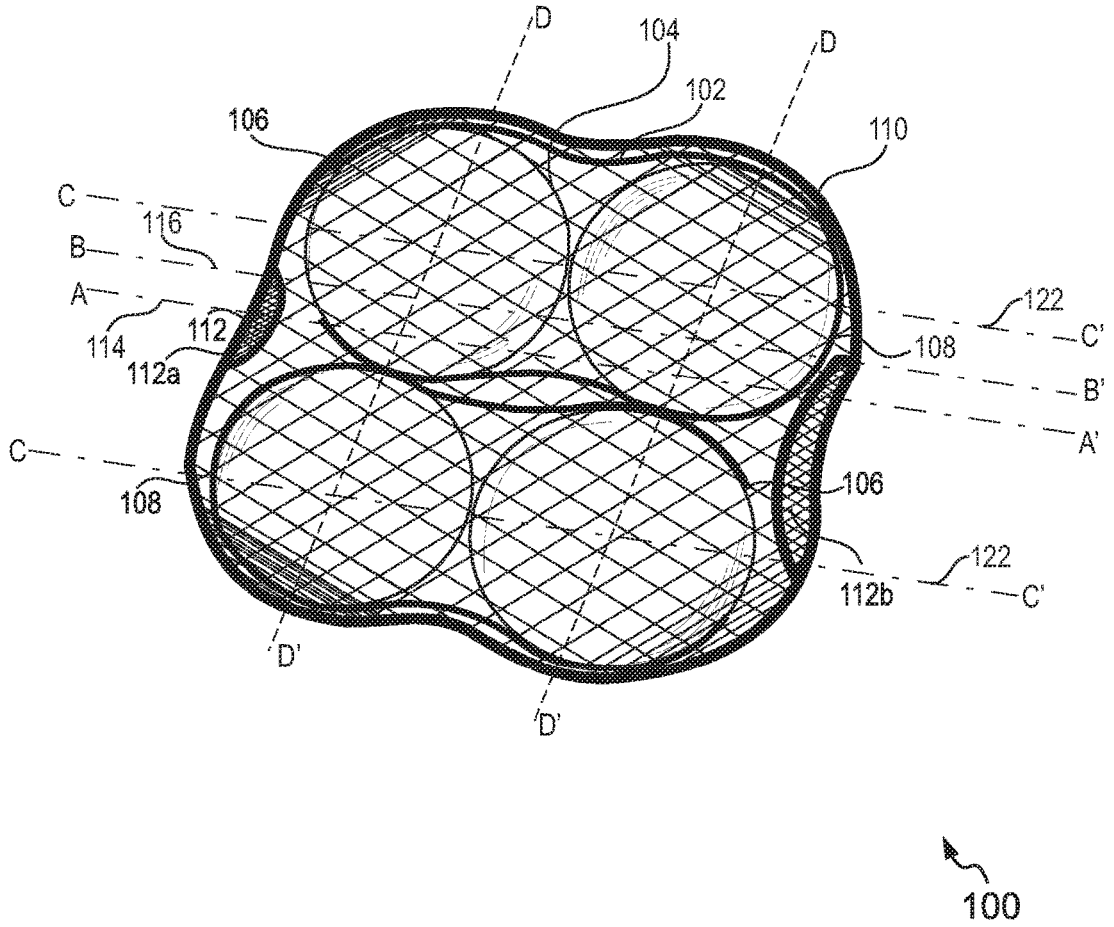
FIG. 1 is a schematic view of a massaging device, in accordance with an exemplary embodiment of the present disclosure.

The drawings referred to in this description are not to be understood as being drawn to scale except if specifically noted, and such drawings are only exemplary in nature.

DETAILED DESCRIPTION

In the following description, for purposes of explanation, numerous specific details are set forth in order to provide a thorough understanding of the present disclosure. It will be apparent, however, to one skilled in the art that the present disclosure can be practiced without these specific details.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

Moreover, the following description contains many specifics for the purposes of illustration, anyone skilled in the art will appreciate that many variations and/or alterations to said details are within the scope of the present disclosure. Similarly, although many of the features of the present disclosure are described in terms of each other, or in conjunction with each other, one skilled in the art will appreciate that many of these features can be provided independently of other features. Accordingly, this description of the present disclosure is set forth without any loss of generality to, and without imposing limitations upon, the present disclosure.

The term 'user' used throughout the disclosure may refer to a person or an animal on whom the treatment or massaging event is being performed. In the present context, the massaging event may be carried out using the massaging device defined in the disclosure. In some cases, a third person may perform the massage on the user and in other cases, the user himself/herself may perform the massage.

Overview

Various embodiments of the present disclosure provide a massaging device for a user for purposes of self-massaging, massaging etc.

Embodiments of the present disclosure provide a massaging device. The massaging device is configured to provide a stable platform for the user during a massaging event. The massaging device may also be configured as a lumbar support device, to provide lumbar support to the user when seated on a seat member. The massaging device includes a plurality of massaging implements and at least one sleeve member adapted to encompass the plurality of massaging implements. Each of the at least one sleeve member is adapted to enclose at least two massaging implements of the plurality of massaging implements aligned in an abutting configuration. Each of the at least two massaging implements forms the abutting configuration within the at least one sleeve member, by adjoining one massaging implement with another massaging implement of the at least two massaging implements. The abutting configuration of the at least two massaging implements within the at least one sleeve member ensures a unibody construction of the plurality of massaging implements. Further, a housing member is provided, which is configured to engage a massaging area on the user. The housing member is also adapted to enclose the plurality of massaging implements encompassed within the at least one sleeve member. The housing member includes at least one aperture for receiving the each of the at least one sleeve member encompassing the plurality of massaging implements. The housing member also aligns each of the at least one sleeve member along its internal axis, so that each of the at least one sleeve member encompassed within the housing member are oriented along a same plane. The housing member ensures that the plurality of massaging implements in the at least one sleeve member are adapted to roll along a direction perpendicular to the internal axis and resist rolling along the direction of the internal axis upon application of a force such as by the user on the housing member during the massaging event on the massaging area. The selective rolling of the plurality of massaging implements provides a stable platform to the user during the massaging event.

Furthermore, the massaging device may include at least one adjustable strap member, for mounting the massaging device on a back-rest member to provide lumbar support to the user resting on the back-rest member.

The term "massaging area" refers to any body part of the user or any skin area of the user that may require a massage.

The term "massaging event" refers to any body part of the user that is being massaged.

Various embodiments of the massaging device for a massage on a massaging area of a user are explained with reference to FIGS. 1 to 20.

FIG. 1, in one exemplary embodiment of the present disclosure, illustrates a perspective view of a massaging device 100. The massaging device 100 is hereinafter referred to as a device 100, may be configured to provide a stable platform or a stable structure to the user during a massaging event, so that the need for manual intervention from the user for maintaining position of the device 100 is mitigated. The massaging device 100 includes at least one sleeve member 102 (hereinafter referred singularly to as a 'sleeve member 102' and jointly as 'sleeve members 102') including a plurality of massaging implements 104 (hereinafter referred to as massaging implements 104).

Figure 2A:
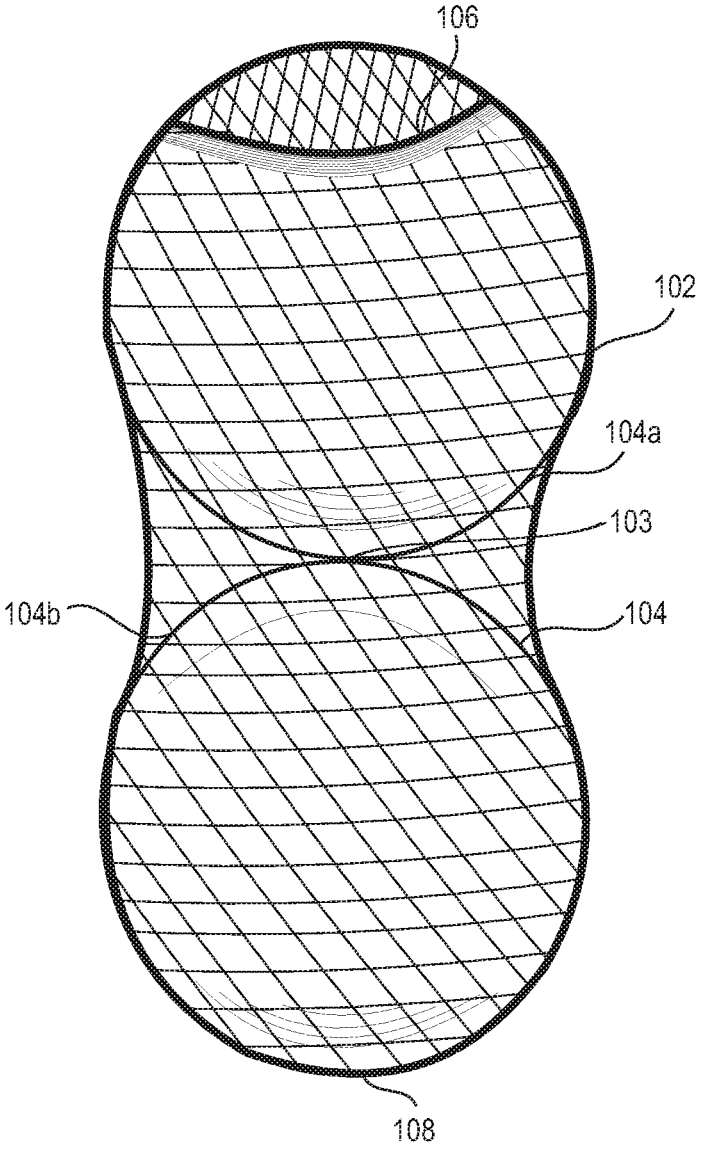
FIG. 2A is a schematic view of at least one sleeve member of the massaging device of FIG. 1, enclosing a plurality of massaging implements, in accordance with an exemplary embodiment of the present disclosure.
Figure 2B:
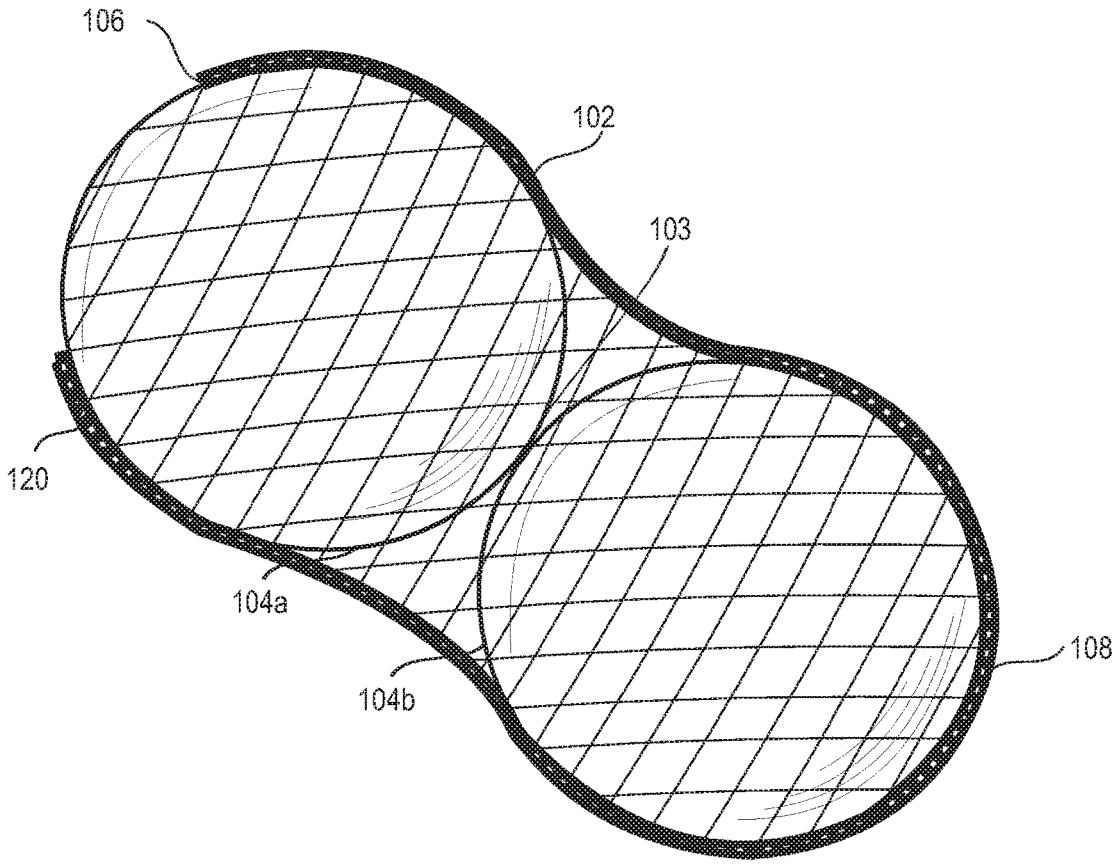
FIG. 2B is a schematic view of the at least one sleeve member of FIG. 2A, in accordance with another exemplary embodiment of the present disclosure.

One example representation of a sleeve member 102 is shown in FIGS. 2A and 2B. The sleeve member 102 is adapted to enclose at least two massaging implements of the plurality of massaging implements 104 aligned in an abutting configuration. The sleeve member 102 includes an open end 106 for receiving the massaging implements 104 therein and a closed end 108 (for e.g., as shown in FIG. 2B) for retaining the massaging implements 104 therein. The sleeve member 102 is also configured such that massaging implements 104 are placed in abutting configuration. The abutting configuration is formed by a contact 103 between one massaging implement 104*a* and another massaging implement 104*b* of the massaging implements 104. The abutting configuration forms a unibody structure of the massaging implements 104, so that the massaging implements 104 acts as a single unit during the massaging event.

Referring back to FIG. 1, a housing member 110 is provided in the massaging device 100, which is configured to engage with a massaging area on the user during the massaging event. The housing member 110 includes at least one aperture 112 for receiving the sleeve member 102 encompassing the massaging implements 104. The housing member 110 encloses the sleeve member 102 received through the aperture 112, such that the sleeve member 102 is aligned parallelly along an internal axis 114 (i.e. axis A-A' as shown in FIG. 1) of the housing member 110. The alignment of the sleeve member 102 along the internal axis 114 of the housing member 110 ensures orientation of the sleeve member 102 along a same plane. In an exemplary embodiment, the internal axis 114 may be an axis of the housing member 110 parallel to an axial plane 116 (i.e. axis B-B' as shown in FIG. 1) of the aperture 112 and thus, the sleeve member 102 is aligned along the axial plane 116 of the aperture 112 upon assembly. The alignment of the sleeve member 102 along the internal axis 114 may result in either a two-dimensional configuration (for e.g., as shown in FIG. 1) or a three-dimensional configuration of the massaging implements 104. This selective configuration of the massaging implements 104 in the housing member 110 renders the modularity of the device 100 and thus the sleeve member 102 may be positioned selectively within the housing member 110 as per requirement.

Figure 3A:
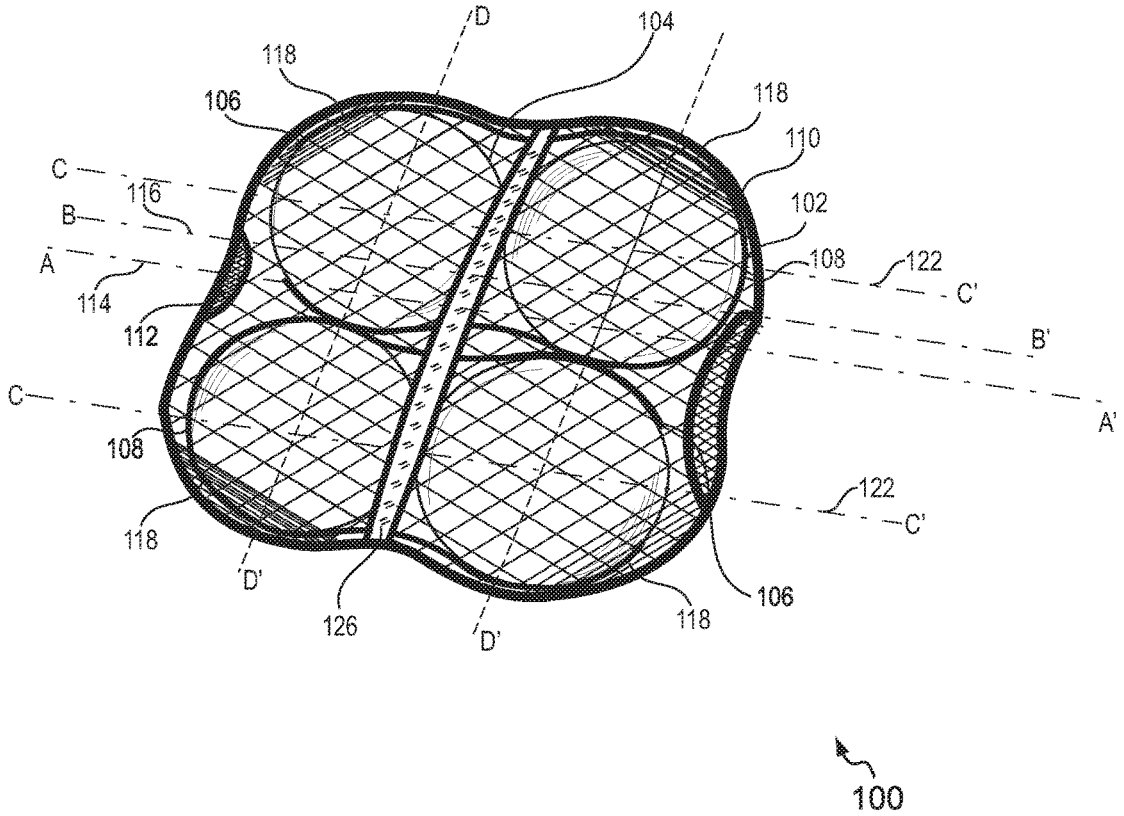
FIG. 3A is a schematic view of the massaging device, prior to a user accessing the at least one sleeve member from a housing member of the massaging device, in accordance with an exemplary embodiment of the present disclosure.
Figure 3B:
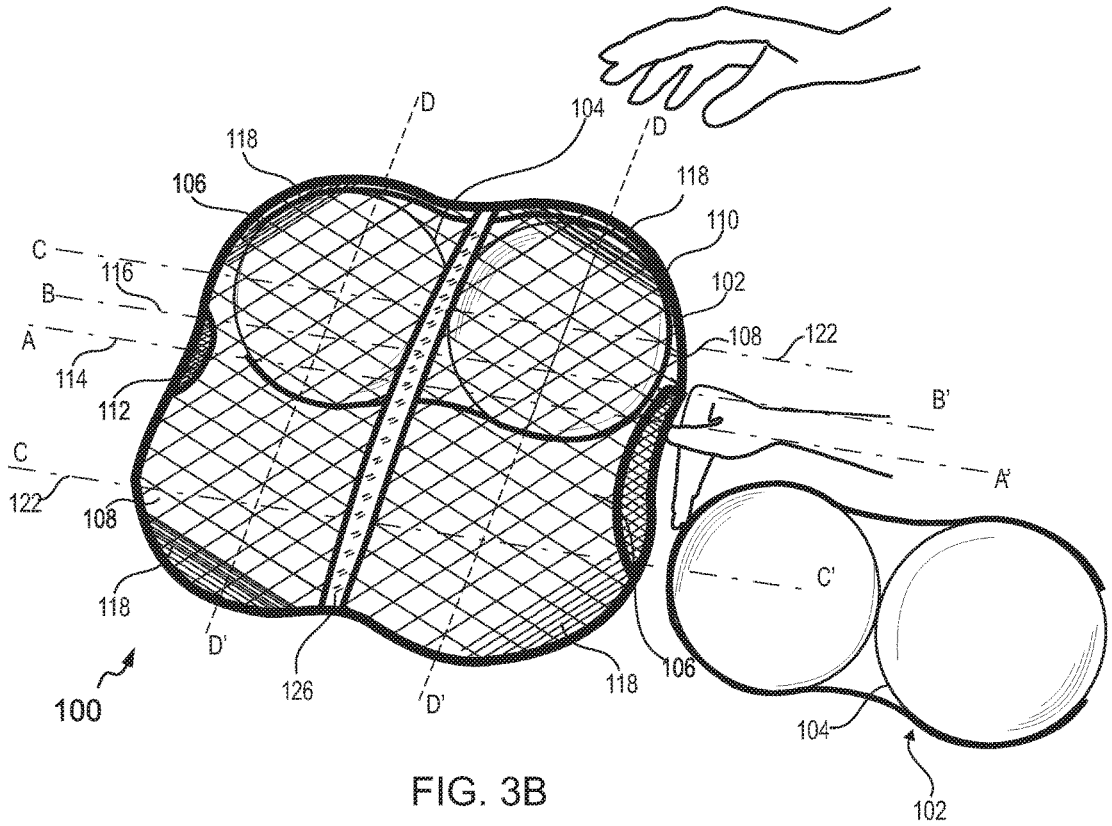
FIG. 3B is a schematic view of the massaging device, illustrating the user accessing the at least one sleeve member for accessing each of the plurality of massaging implements, in accordance with an exemplary embodiment of the present disclosure.
Figure 3C:
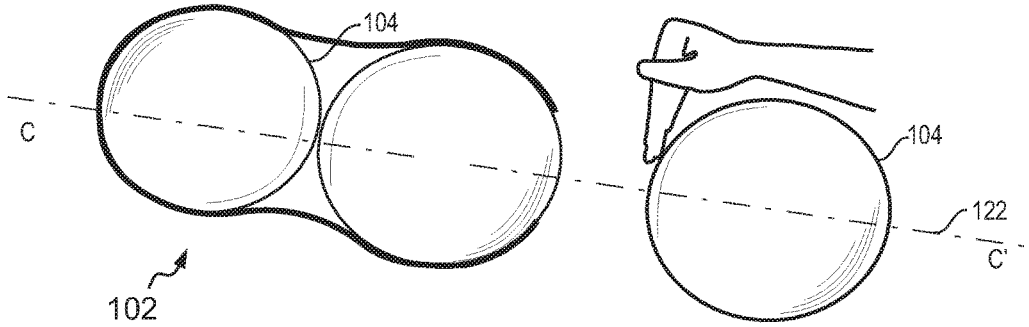
FIG. 3C is a schematic view of the massaging device, illustrating the user removing one of the plurality of massaging implements from the at least one sleeve member, in accordance with an exemplary embodiment of the present disclosure.

Referring now to FIG. 3A in conjunction with FIG. 1, the massaging implements 104 may be enclosed within the housing member 110 such that, at least a part of a boundary surface of each of the massaging implements 104 projects outwardly from the housing member 110 as a protrusion 118. The protrusion 118 enables the user to access each of the massaging implements 104 via accessing the sleeve member 102 (for e.g. as shown in FIG. 3B), so that the user can isolate the massaging implements 104 from the housing member 110 as and when required (for e.g. as shown in FIG. 3C). In other words, in the event that the user requires altering the configuration of the massaging implements 104 within the housing member 110, the user can directly access and remove the massaging implements 104 individually via the aperture 112. The alteration of the configuration of the massaging implements 104 may be carried out for adjusting contact pressure from the device 100 or for sizing the device 100 as per the surface area of the massaging area. In an exemplary embodiment, for higher pressure requirements, the user may remove multiple massaging implements 104 from the housing member 110, so that the pressure energy gets concentrated between the remaining massaging implements 104. The isolated massaging implements 104 may be separately used along with the device 100 for simultaneously massaging another massaging area. In another exemplary embodiment, for lower pressure requirements, the user may add multiple massaging implements 104 into the housing member 110, so that the pressure energy gets dispersed between the massaging implements 104.

In an embodiment, shape or structure of the massaging implements 104 may be spherical, rectangular or any other geometric shape as per requirement.

In another embodiment, dimensions of each of the massaging implements 104 may be selected based on the pressure requirements during the massaging event.

In an embodiment, the massaging implements 104 of similar dimensions may be encompassed within the sleeve member 102. In another embodiment, the massaging implements 104 of varying dimensions may be encompassed within the sleeve member 102. In an embodiment, there may be a single sleeve member 102 that may enclose all the massaging implements 104.

In an embodiment, the sleeve member 102 enclosed within the housing member 110 may also be inclined with respect to the axial plane 116 or the internal axis 114 as per feasibility and requirement. The possibility of inclination of the sleeve member 102 within the housing member 110, provides flexibility to the user to configure and choose placement of the sleeve member 102 within the housing member 110 as per requirement.

In an embodiment, the sleeve member 102 may be enclosed within the housing member 110 in a grid configuration or a crisscross configuration as per requirement.

In an embodiment, the unibody structure of the massaging implements 104 within the sleeve member 102 may be a peanut-shaped structure. In another embodiment, the unibody structure of the massaging implements 104 may assume an L-shape, a V-shape of any other shape as per design feasibility and requirement.

In an embodiment, the sleeve member 102 may comprise a flexible material, so that the sleeve member 102 may accommodate dimensional tolerances or misalignment of the massaging implements 104. The sleeve member 102 comprising of flexible material will also ensure that the position of the massaging implements 104 may be altered to calibrate their position, as per the massaging area and the pressure requirements. For example, in the event of requirement of reduced pressure from the massaging implements 104 on a portion of the massaging area, one of the massaging implements 104 in the sleeve member 102 may be raised or lowered, to reduce a contact portion between the massaging implements 104 and the portion of the massaging area. Thus, as the contact portion between the portion of the massaging area and the massaging implements 104, which may be raised or lowered, is altered, the pressure experienced in the portion of the massaging area is altered accordingly. In an embodiment, the flexible material of the sleeve member 102 may be a graphite material, a polycarbonate material, a urethane material or any other material which serves design feasibility and requirement. In another embodiment, the sleeve member 102 may comprise a stiffer material along with the flexible material for improving its durability.

In an embodiment, the sleeve member 102 may be made of a meshed fabric for additional flexibility and enhanced heat or temperature dissipation characteristics.

In an embodiment, the sleeve member 102 may also include at least one cushion layer 120. The cushion layer 120 may be configured in the sleeve member 102 for providing cushioning effect to the user during the massaging event. The cushion layer 120 may be provided in between a fabric layer of the sleeve member 102 (for e.g., shown in FIG. 2B). In another embodiment, the cushion layer 120 may also be provided on an outer surface of the sleeve member 102 or on an inner surface of the sleeve member 102 as per requirement.

In an embodiment, the sleeve member 102 may be an elongated structure configured to receive the massaging implements 104. The elongated structure of the sleeve member 102 may ensure that the massaging implements 104 are aligned in-line, such that one massaging implement 104*a* abuts with the adjacent massaging implement 104*b* (for e.g., as shown in FIG. 2A).

Figure 4:
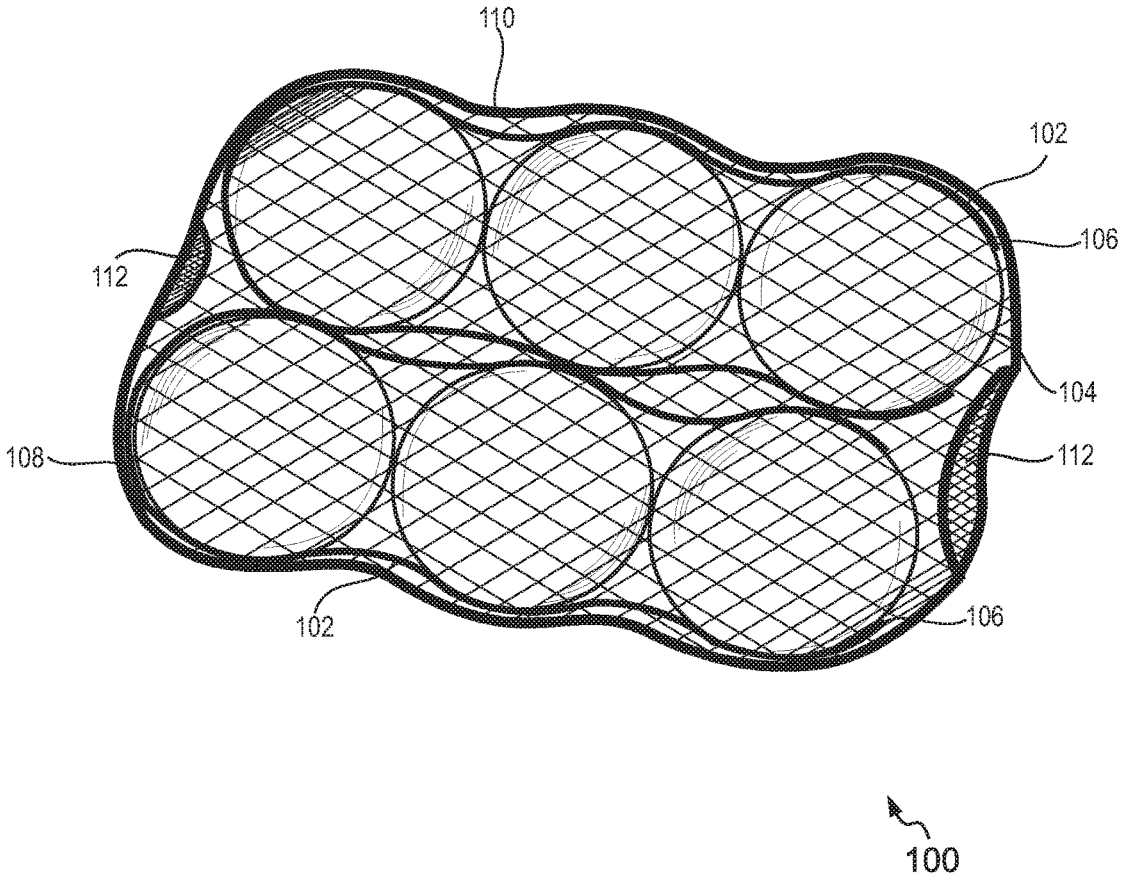
FIG. 4 is a schematic view of the massaging device, in accordance with another exemplary embodiment of the present disclosure.

In an embodiment, the abutting configuration of the massaging implements 104 may be a configuration in which the neighboring massaging implements may abut or adjoin with one another to form a butt-joint configuration (for e.g., as shown in FIG. 2A and FIG. 4).

In an embodiment, the sleeve member 102 may include a minimum of two massaging implements 104 (for e.g., as shown in FIG. 2A) or at least two massaging implements 104. In another embodiment, the sleeve member 102 may include three massaging implements 104 (for e.g., as shown in FIG. 4), so that a larger surface area is available for contacting the massaging area of the user for the massaging event.

In an embodiment, size of the open end 106 may be selected such that, the massaging implements 104 are held in place during the massaging event.

In an embodiment, a gripping member (not shown in Figures) may extend from the sleeve member 102, for ease of handling of the sleeve member 102. In another embodiment, the gripping member may be a tape-like structure, which facilitates gripping of the sleeve member 102 for handling.

In an embodiment, the two-dimensional configuration of the housing member 110 may include the massaging implements 104 extending along a two-dimensional plane which may be selected from any two of a length dimension, a width dimension or a thickness dimension. In other words, by considering the typical co-ordinate system, the sleeve member 102 encompassing the massaging implements 104 may be placed along any two of the x-axis, the y-axis and the z-axis to form the two-dimensional configuration of the housing member 110. In the two-dimensional structure, the housing member 110 may be shaped in a rectangular configuration, a square configuration, a parallelogram configuration or any other configuration as per requirement.

In an embodiment, for configuring the housing member 110 in the two-dimensional configuration, a minimum of two sleeve members 102 may be required. The two sleeve members 102 may be placed along any two of the length dimension, the width dimension and the thickness dimension. In another embodiment, multiple sleeve members 102 may be positioned along any two of the length dimension, the width dimension and the thickness dimension as per the desired configuration and structure of the housing member 110.

Figure 5:
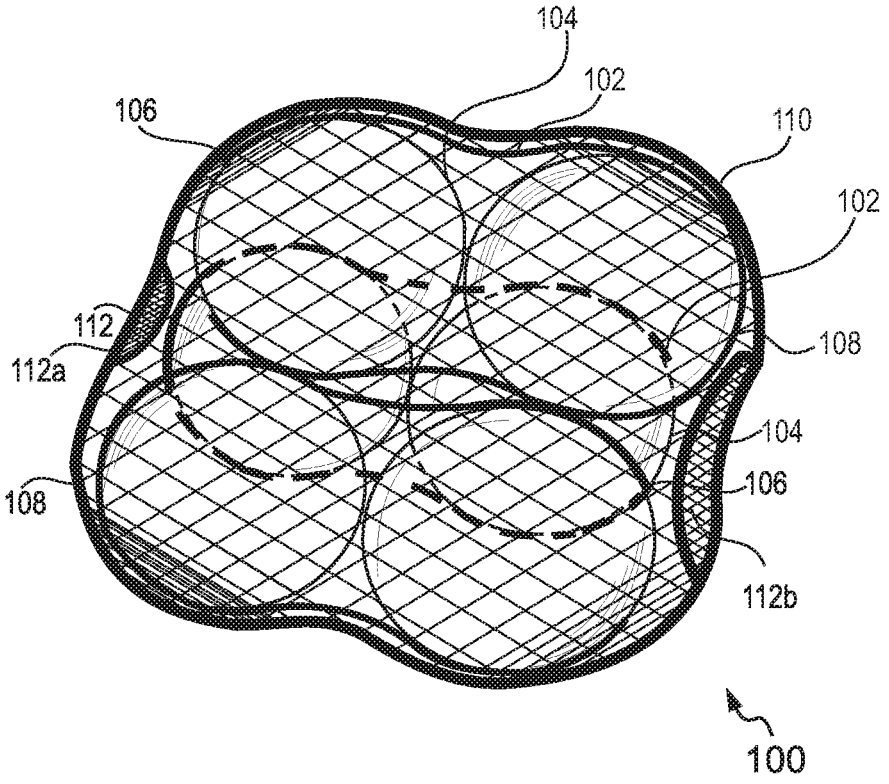
FIG. 5 is a schematic view of the three-dimensional configuration of the massaging device, in accordance with another exemplary embodiment of the present disclosure.

In an embodiment, the three-dimensional structure of the housing member 110 may include the massaging implements 104 extending in three-dimensions i.e. the length dimension, the width dimension and the thickness dimension (for e.g. as shown in FIG. 5). In other words, by considering the typical co-ordinate system, the sleeve member 102 encompassing the massaging implements 104 may be placed along the x-axis, the y-axis and the z-axis to form the three-dimensional configuration of the housing member 110. In the three-dimensional configuration, the housing member 110 may be shaped in a hyper-rectangular configuration, a cube configuration, a cuboid configuration or any other configuration as per requirement.

In an embodiment, for configuring the housing member 110 in the three-dimensional structure, a minimum of three sleeve members 102 encompassing the massaging implements 104 may be required (for e.g. as shown in FIG. 5). The three sleeve members 102 may each be placed along the length dimension, the width dimension and the thickness dimension to arrive at the three-dimensional configuration. In another embodiment, multiple sleeve members 102 may be positioned along the length dimension, the width dimension and the thickness dimension as the desired configuration and structure of the housing member 110.

In an embodiment, the housing member 110 may be made of a flexible material, so that the housing member 110 may accommodate dimensional tolerances or misalignment of the massaging implements 104. The housing member 110 made of flexible material will also ensure that the position of the massaging implements 104 may be altered to calibrate their position, as per the massaging area and the pressure requirements. In an embodiment, the flexible material of the housing member 110 may be a graphite material, a polycarbonate material, a urethane material or any other material which serves design feasibility and requirement.

In an embodiment, the housing member 110 may also include one sleeve member 102 as per user's requirement.

In an embodiment, the axial plane 116 of the aperture 112 may be along an x-axis as per typical Cartesian co-ordinate system. Thus, the sleeve member 102 may be aligned along the x-axis, when the housing member 110 encloses the sleeve member 102.

In an embodiment, the aperture 112 may include a first aperture 112*a* and a second aperture 112*b* located on opposite sides of the housing member 110 (for e.g., as shown in FIG. 1). In another embodiment, the first aperture 112*a* may act as an entrance while the second aperture 112*b* may act as an exit for the sleeve member 102. In another embodiment, size of the first aperture 112*a* and the second aperture 112*b* may be selected such that, the sleeve member 102 is held in place during the massaging event. In another embodiment, the aperture 112 may include four apertures, along the opposite faces of the housing member 110.

In an embodiment, each of the sleeve member 102 may include a longitudinal axis 122 (i.e. axis C-C' as shown in FIG. 1), with reference to which each of the sleeve member 102 is aligned with the internal axis 114 of the housing member 110.

In an embodiment, a clasping member 126 (for e.g. as shown in FIG. 3A) extends from the housing member 110 for ease of handling of the housing member 110. In another embodiment, the clasping member 126 may be a tape like structure, which facilitates gripping of the housing member 110 for handling.

Figure 6:
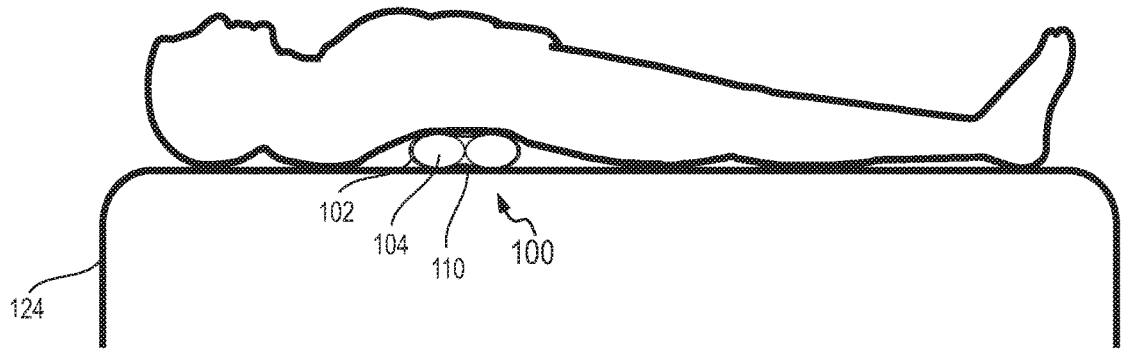
FIG. 6 is a schematic view of the massaging device in use by the user for a massaging event, in accordance with an exemplary embodiment of the present disclosure.

FIG. 6, in one exemplary embodiment of the present disclosure, illustrates a user employing the device 100 for a back massage. The device 100 may be positioned under the user's back, once the user rests on a floor 124. The device 100 due to its flat surface area supports the user, thereby mitigating manual intervention of the user for maintaining position of the device 100. In this condition, due to the user's bodyweight acting on the device 100, the massaging implements 104 impart a counter pressure force on the user's back, thereby providing a massage. During the massaging event, if the user is in requirement for engaging a larger surface area of the massaging area, the device 100 which has the larger surface area (for e.g., as shown in FIG. 4) may be employed. Similarly, if the user is in requirement for engaging a smaller surface area of the massaging area, the size of the device 100 may be reduced by accessing the sleeve member 102 and removing the massaging implements 104 (for e.g., as shown in FIGS. 3A-3C).

Further, the user may alter the location of the device 100 on the massaging area by rolling over the device 100. Due to the configuration of the housing member 110 and the sleeve member 102 over the massaging implements 104, the massaging implements 104 are rotatable along an axis D-D' (for e.g., as shown in FIG. 1), which is lateral with respect to the internal axis 114 of the housing member 110. At the same time, the configuration of the housing member 110 and the sleeve member 102 restricts rotation of the massaging implements 104 along the internal axis 114. The restriction of rotation of the massaging implements 104 along the internal axis 114 is achieved due to the abutting configuration of the massaging implements 104 in the sleeve member 102. In other words, due to unibody configuration of the massaging implements 104, the force exerted by the user along the direction of the internal axis 114 restricts movement of the massaging implements 104 along the internal axis 114 and thus, ensure that the device 100 only rolls along a single plane or axis. This configuration of the device 100 by allowing rotation of the massaging implements 104 along the single plane or axis provides a stable platform for the user during the massaging event.

In an exemplary embodiment, the user upon placing the device 100 on his back may alter position of the device 100 along his height direction, by rolling the user's body over the device 100.

In an embodiment, by considering conventional cardinal directions, the massaging implements 104 in the device 100 may be rotatable along north-south direction, while resisting rotation along east-west directions. Thus, the position of the device 100 may be altered along the north-south directions by rolling over the device 100.

Figure 7:
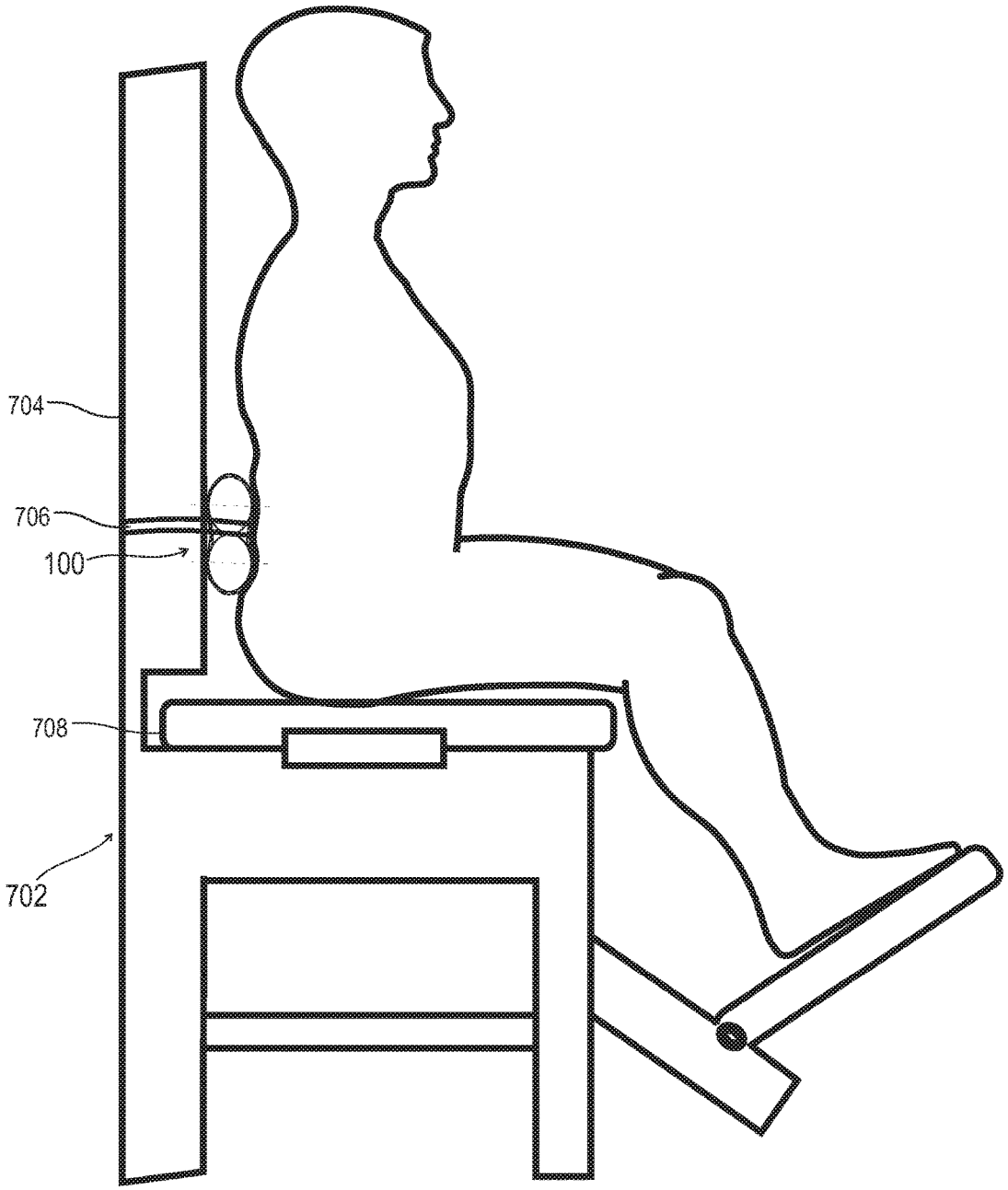
FIG. 7 is a schematic view of the massaging device used as lumbar support by the user in accordance with an embodiment of the present disclosure.

FIG. 7, in one exemplary embodiment of the present disclosure, illustrates the device 100 used as a lumbar support device. The device 100 may be mounted to a back-rest member 704 of a seat 702, so that the device 100 may provide lumbar support to the user while resting on the back-rest member 704.

The device 100 may include at least one adjustable strap member 706 extending from the housing member 110 and connectable to the back-rest member 704 of the seat 702. The adjustable strap member 706 mounts the device 100 on the back-rest member 704 such that, the device 100 contacts the user's back, when the user rests on the seat 702. The adjustable strap member 706 may be adjustable on the back-rest member 704, so that the position of the device 100 may be adjusted as per user's requirement.

In an embodiment, the configuration of the device 100 i.e. either of the two-dimensional configuration or the three-dimensional configuration of the device 100 may be considered for use as the lumbar support device.

In an embodiment, the device 100 along with the adjustable strap member 706 may also be mounted on a seat member 708 of the seat 702 for use as a thigh support device (not shown in Figures).

In an embodiment, the adjustable strap member 706 may be strapped to the user such that the device 100 is positioned on the user's back, and that the device 100 may massage the user's back, when the user rests on the seat 702. In another embodiment. the adjustable strap member 706 may be strapped on any strained body part of the user for the massage.

In an embodiment, each of the massaging implements 104 may rotate independently of one another within the sleeve member 102 upon application of the force during the massaging event.

In an embodiment, the adjustable strap member 706 may be a Velcro® fastener, a buckle or any other fastening member which serves the purpose of mounting the device 100 on the seat 702.

Figure 8:
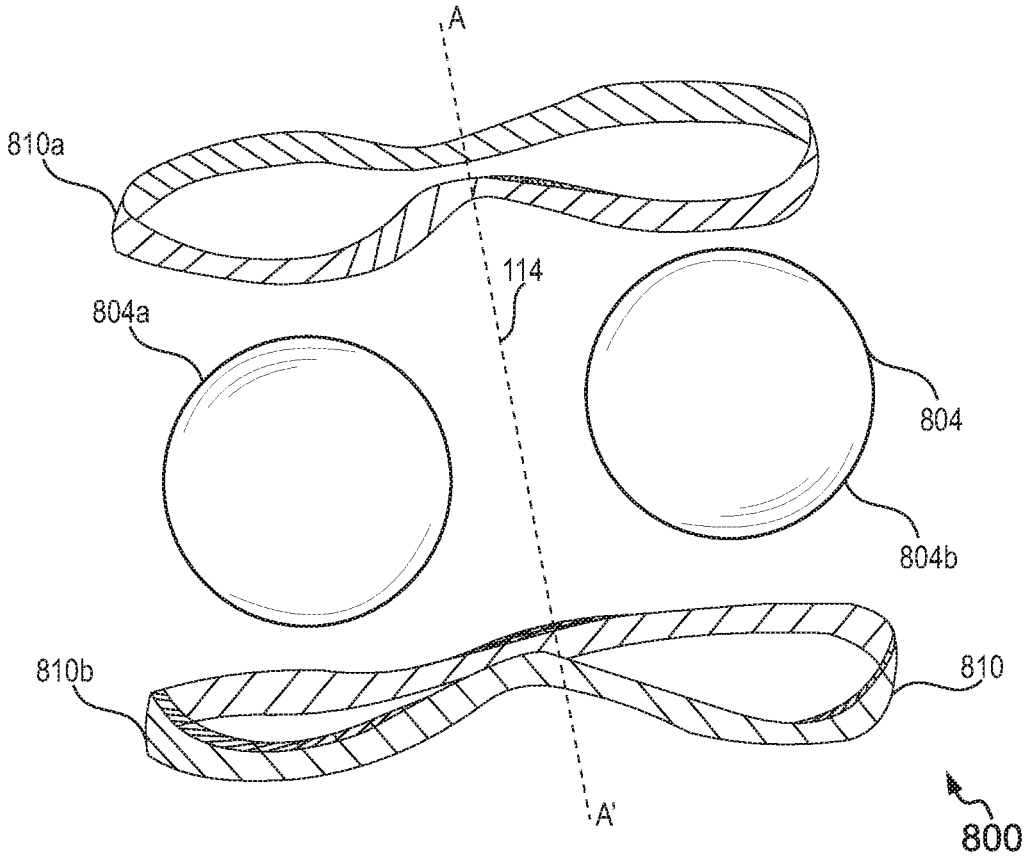
FIG. 8 is a schematic view of the massaging device, in accordance with another embodiment of the present disclosure.
Figure 9:
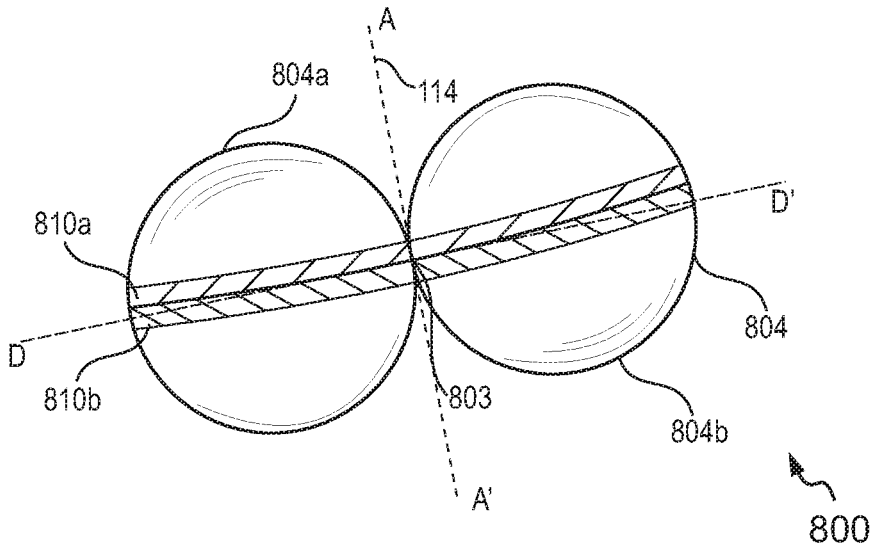
FIG. 9 is a schematic view of the massaging device of FIG. 8, illustrating abutting configuration of the massaging implements, in accordance with an embodiment of the present disclosure.

FIG. 8, in another exemplary embodiment of the present disclosure, illustrates a schematic view of a massaging device 800. The massaging device 800 is hereinafter referred to as a device 800 and includes at least one housing member 810 (hereinafter referred singularly to as a housing member 810') enclosing a plurality of massaging implements 804 (hereinafter referred to as massaging implements 804). The housing member 810 is adapted to engage the massaging area on the user during the massaging event and also encloses at least two massaging implements of the plurality of massaging implements 804 aligned in an abutting configuration, thereby mitigating the requirement of the sleeve member 102 (for e.g. as shown in FIG. 1). The housing member 810 may be a flexible strap-like member, which may be directly mounted on the at least two massaging implements 804. The housing member 810 may be configured such that the massaging implements 804 are placed in abutting configuration (as shown in FIG. 9). The abutting configuration is formed by a contact 803 between one massaging implement 804*a* and another massaging implement 804*b* of the massaging implements 804. The abutting configuration forms a unibody structure of the massaging implements 804, so that the massaging implements 804 acts as a single unit during the massaging event. The unibody construction of the massaging implements 804 ensures that the massaging implements 804 are rotatable along an axis D-D' (for e.g., as shown in FIG. 9), which is lateral with respect to the internal axis 114 of the housing member 810. At the same time, rotation of the massaging implements 804 with respect to the internal axis 114 is restricted.

In another embodiment, the massaging implements 804 may be configured to extend longitudinally along the internal axis 114 of the housing member 810 such that the rotation of the massaging implements 804 with respect to the internal axis 114 is restricted by means of the geometry and length of said massaging implements 804. In this embodiment, for example, the spherical massaging implements 804*a* and 804*b* illustrated in FIGS. 8 and 9 may instead be elongated massaging implements 804*a* and 804*b* (not shown in FIGS.). Configuring the elongated massaging implements 804*a* and 804*b* to be oriented longitudinally along the internal axis 114 of the housing members 810*a* and 810*b* results in an assembled massaging device 800 wherein the massaging device 800 resists rolling along the direction of the internal axis 114 but is adapted to favorably roll laterally from the internal axis 114, such as in a perpendicular direction from the internal axis 114. It is noted that such lateral rolling of the massaging device 800 may be, for example, at any angle displaced from the internal axis 114.

Further, the massaging implements 804 enclosed within the housing member 810 may be aligned parallelly along an internal axis 114 (i.e. axis A-A' as shown in FIG. 8) of the housing member 810. The alignment of the massaging implements 804 along the internal axis 114 of the housing member 810 ensures orientation of the massaging implements 804 along a same plane. This selective configuration of the massaging implements 804 in the housing member 810 renders the modularity of the device 800. In an embodiment, the housing member 810 may include two housing members 810*a* and 810*b*, which may be disposed on the massaging implements 804*a* and 804*b*, for reinforcing the contact 803 between the massaging implements 804.

Figure 10:
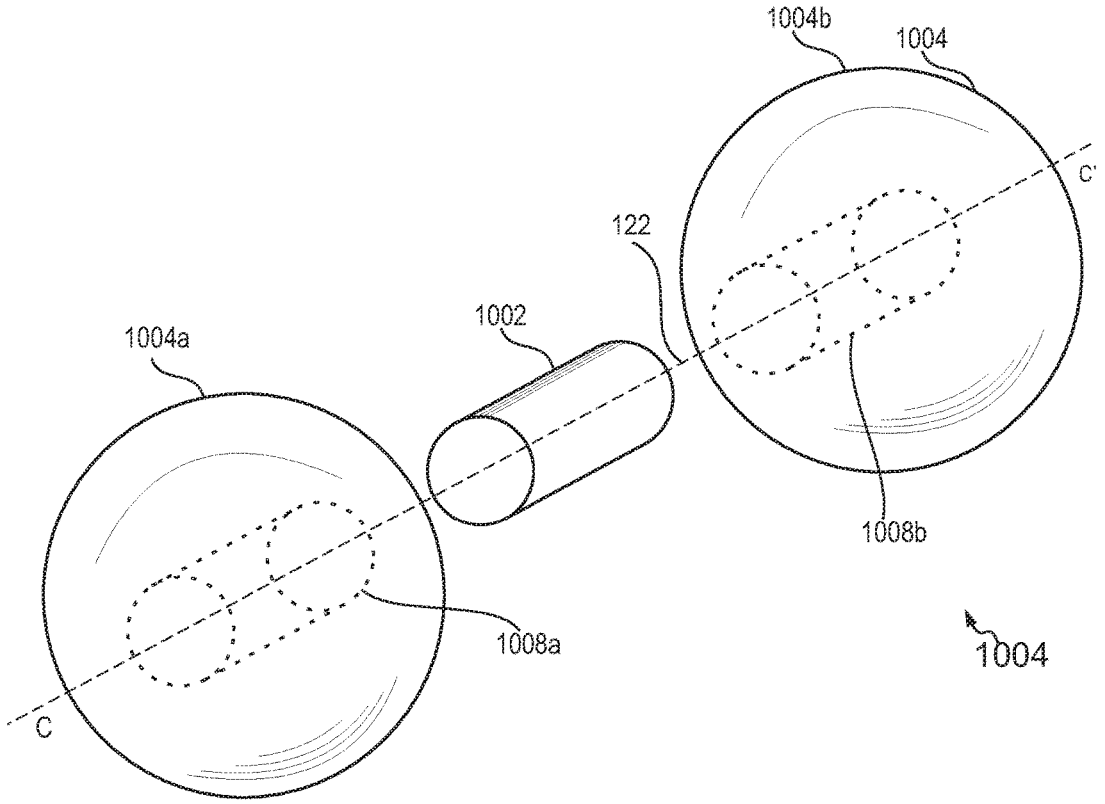
FIG. 10 is a schematic exploded view of one of a plurality of unitary massaging implements of the plurality of massaging implements connected by a connecting member, in accordance with an embodiment of the present disclosure.
Figure 11:
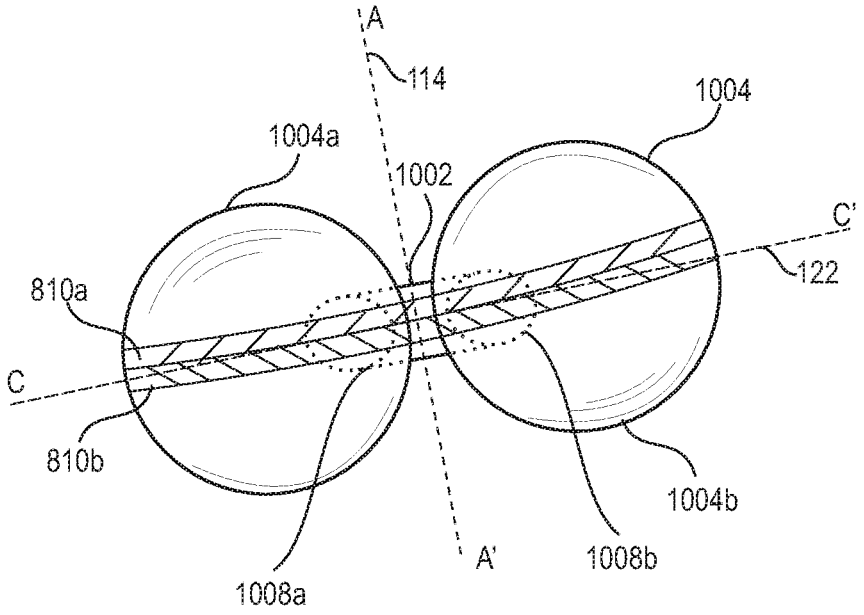
FIG. 11 is a schematic view of one of the plurality of unitary massaging implements of FIG. 10, in accordance with an embodiment of the present disclosure.

Referring to FIG. 10 in conjunction with FIG. 8, the massaging implements 804 may include a plurality of unitary massaging implements 1004 (hereinafter referred to as unitary massaging implements 1004). Each of the unitary massaging implements 1004 includes at least two massaging implements, connected to form the abutting configuration via a connecting member 1002. Each of the unitary massaging implements 1004 may include two massaging implements 1004*a* and 1004*b* configured to abut each other via the connecting member 1002. Each of the massaging implements 1004 includes a cavity for receiving the connecting member 1002. The massaging implements 1004*a* and 1004*b* may include cavities 1008*a* and 1008*b* respectively, for receiving ends of the connecting member 1002. The connecting member 1002, upon insertion into said cavities, binds the massaging implements 1004*a* and 1004*b* together to form unitary massaging implement 1004 (for e.g. as shown in FIG. 11). The connecting member 1002 thus forms a unitary structure of the massaging implements.

In another embodiment, the connecting member 1002 may comprise a sleeve member 102 as illustrated in FIG. 1 and discussed above wherein said connecting member 1002 forms, with the massaging implements 104 disposed therein, a unitary structure of massaging implements.

Figure 12:
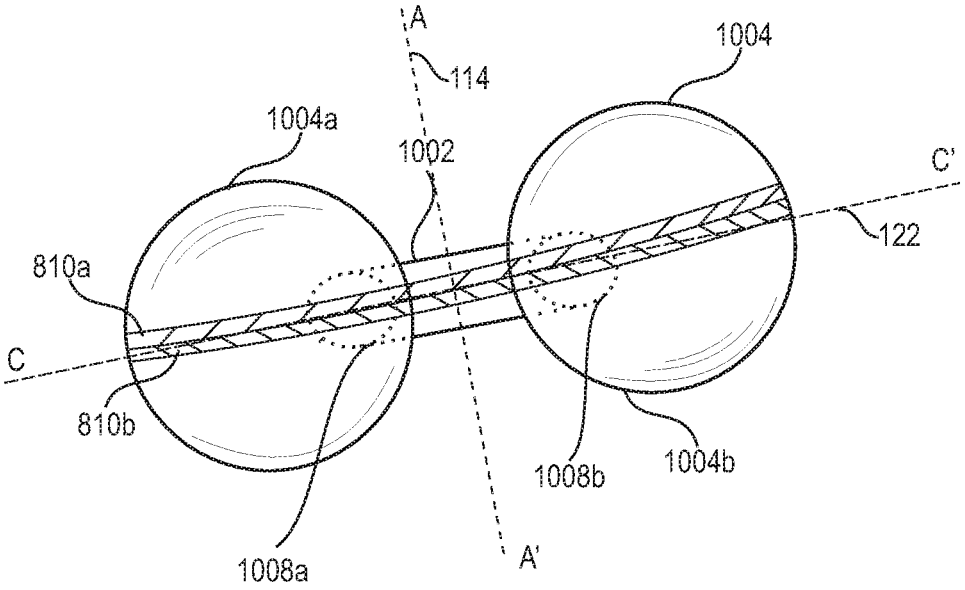
FIG. 12 is a schematic view of the plurality of unitary massaging implements of FIG. 10, in accordance with another embodiment of the present disclosure.

In an embodiment, the connecting member 1002 may also allow the massaging implements 1004*a* and 1004*b* to slide along its length, for adjusting the distance between the massaging implements 1004*a* and 1004*b*, as per requirement to the user (for e.g. as shown in FIG. 12). The adjustment of distance between the massaging implements 1004*a* and 1004*b*, may enable the user to contact distant areas in the massaging area.

In an embodiment, the connecting member 1002 may be a telescopic member (not shown in Figures) for adjusting the distance between the massaging implements 1004*a* and 1004*b*. In an embodiment, the connecting member 1002 may include slots along its length for receiving a pin (not shown in Figures), so that the pin may lock further movement of the massaging implements 1004*a* and 1004*b* along the length of the connecting member 1002.

Figure 13:
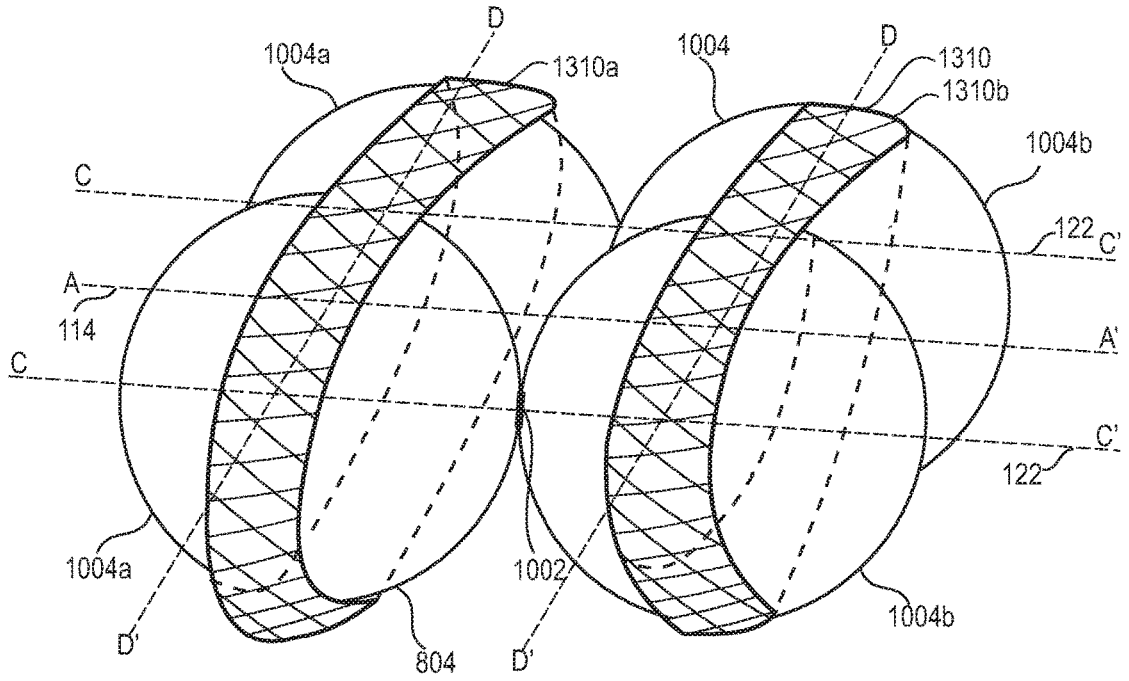
FIG. 13 is a schematic view of at least two unitary massaging implements enclosed in the housing member, in accordance with an embodiment of the present disclosure.

In an embodiment, the connecting member 1002 may be connected to the massaging implements 1004*a* and 1004*b* by means such as snap fitting, interference fit, fastening or any other means as per design feasibility and requirement. In an embodiment, the connecting member 1002 may be a binding member configured to adhere onto the surface of the massaging implements 1004*a* and 1004*b* (for e.g. as shown in FIG. 13). In an embodiment, the connecting member 1002 may be configured to be the binding member, a tube member (for e.g. as shown in FIG. 11), a cylindrical member or any other member as per design feasibility and requirement.

Referring still to FIG. 13, dimensions of the housing member 1310 may be configured based on the binding characteristics and the strength of the joint between the massaging implements 1004*a* and 1004*b*. The housing member 1310 may be configured to enclose at least two unitary massaging implements 1004 (for e.g. as shown in FIG. 13). The housing member 1310 may include two housing members 1310*a* and 1310*b*, which may be configured to contact the circumference of the massaging implements 1004*a* and 1004*b* respectively of each of the unitary massaging implements 1004, for additional stability of the massaging device 800 during the massaging event. The unitary massaging implements 1004 of FIG. 13 may be aligned along the internal axis 114 of housing member 1310, similar to the sleeve member 102 of FIG. 1 that may be aligned along longitudinal axis 122. The alignment of the unitary massaging implements 1004 is adapted for rolling along the axis D-D', which is lateral, though not necessarily perpendicular, with respect to the internal axis 114 of housing member 1310. At the same time, rotation of unitary massaging implements 1004 along with its constituent parts, such as massage implements 804 and connecting member 1002, along the internal axis 114 is restricted. In an embodiment, the unitary massaging implements 1004 may be aligned laterally to the internal axis 114 of the housing member 1310 as per feasibility and requirement.

Figure 14:
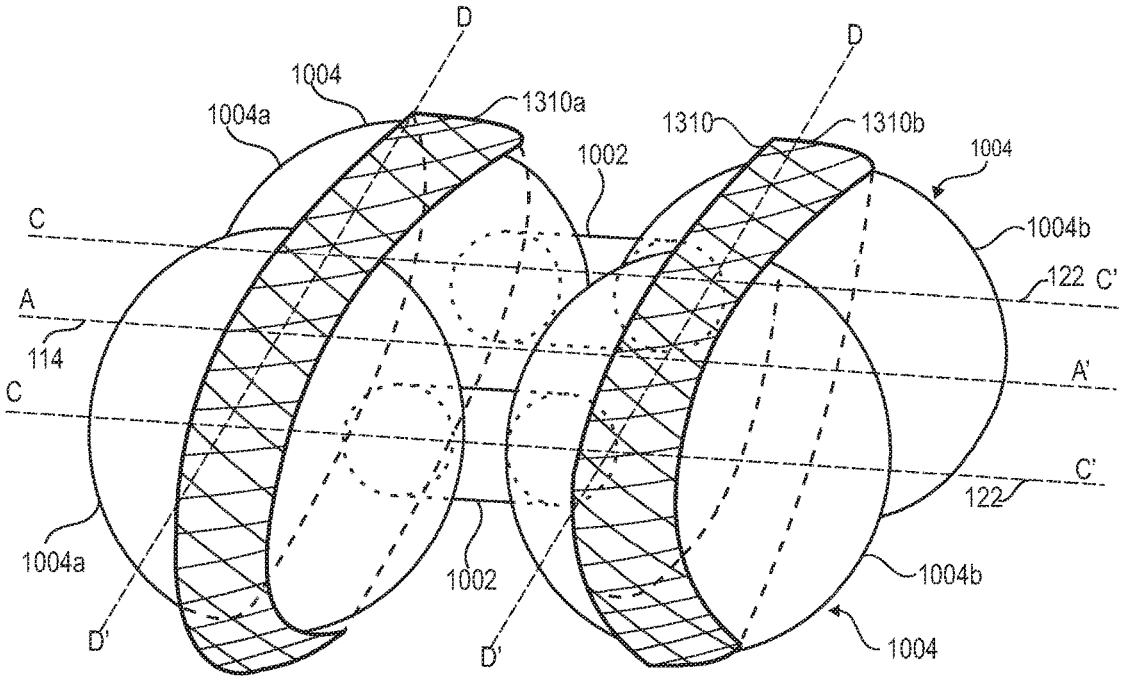
FIG. 14 is a schematic view of at least two unitary massaging implements enclosed in the housing member, in accordance with another embodiment of the present disclosure.

In an embodiment, the housing member 1310 may also be configured to enclose the unitary massaging implements 1004 connected by the tubular configuration of the connecting member 1002 (for e.g. as shown in FIG. 14). In this configuration, the housing member 1310 may include two housing members 1310*a* and 1310*b*, which may be configured to contact the circumference of the massaging implements 1004*a* and 1004*b*, respectively, of each of the unitary massaging implements 1004. In an embodiment, a single housing member 1310 may be configured to encompass and engage the connecting members 1002 of each of the plurality of unitary massaging implements 1004 for forming an abutting configuration amongst adjacent unitary massaging implements 1004 (not shown in the Figures).

Figure 15:
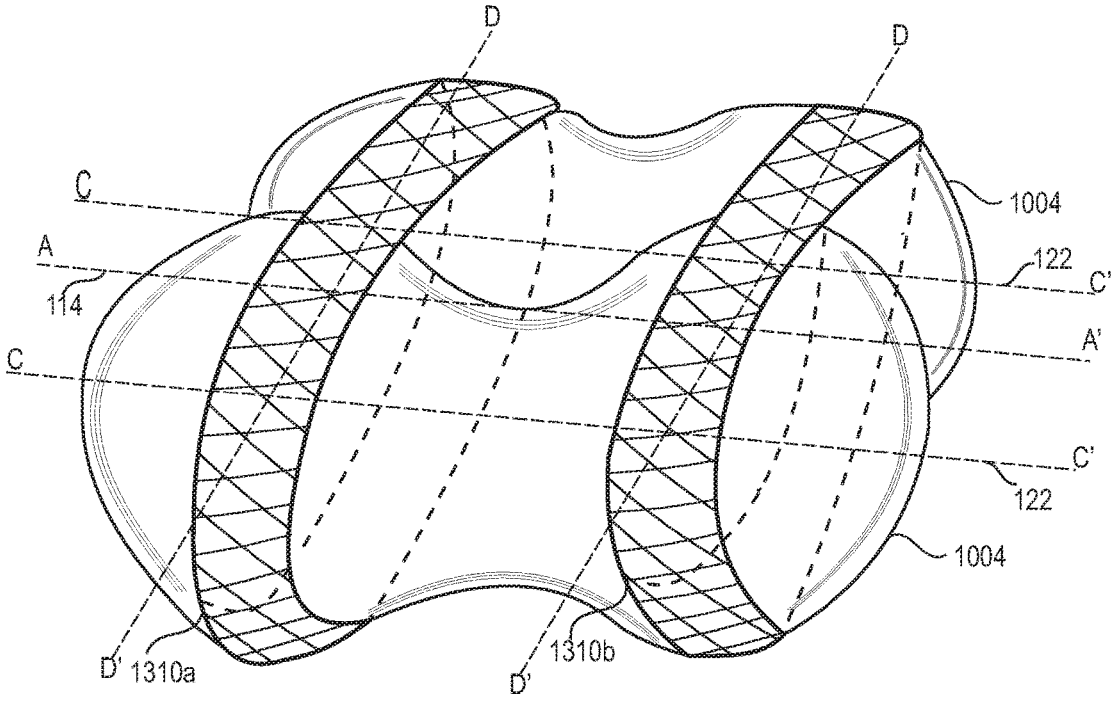
FIG. 15 is a schematic view of at least two unitary massaging implements enclosed in the housing member, in accordance with another embodiment of the present disclosure.

In an embodiment, the housing member 1310 may be configured to enclose the unitary massaging implements 1004 which may be configured to be a peanut-shaped configuration (for e.g. as shown in FIG. 15).

Figure 16:
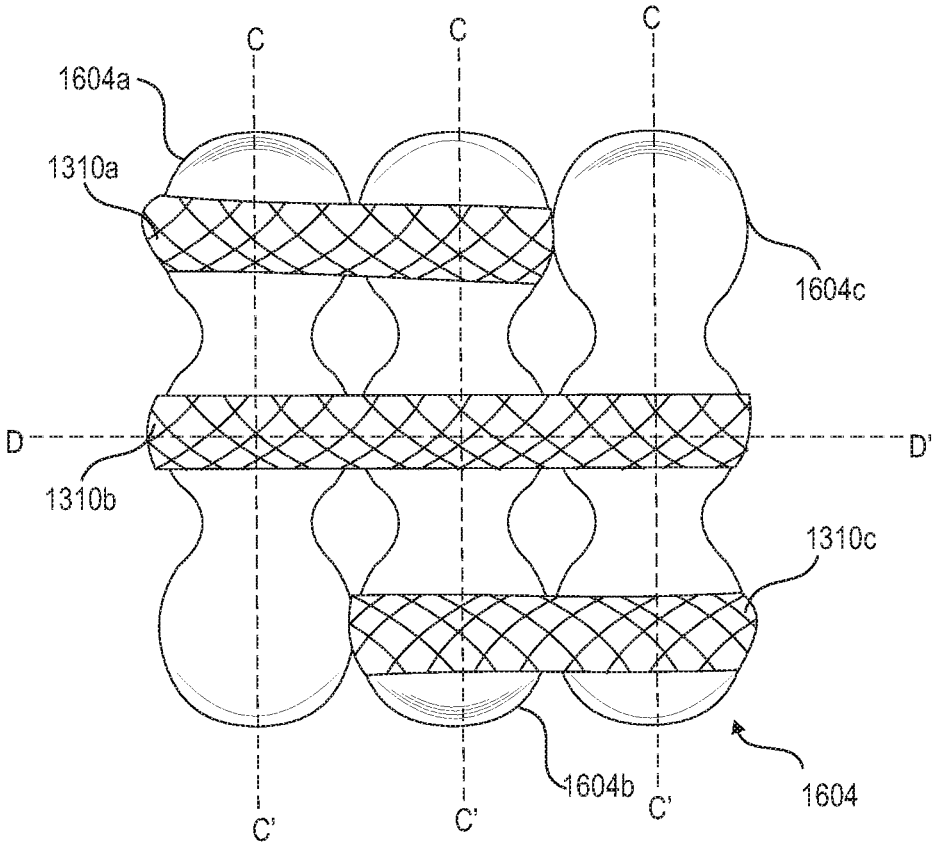
FIG. 16 is a schematic view of at least three unitary massaging implements enclosed in the housing member, in accordance with an embodiment of the present disclosure.

In an embodiment, the unitary massaging implement 1004 may include three massaging implements 1604*a*, 1604*b* and 1604*c* in an abutting configuration, collectively illustrated as the unitary massaging implements 1604 in FIG. 16. The unitary massaging implements 1604 may be a peanut-shaped massaging implement. In an embodiment, the housing member 1310 may include three housing members 1310*a*, 1310*b* and 1310*c*, for enclosing three unitary massaging implements 1604*a*, 1604*b* and 1604*c* (for e.g. as shown in FIG. 16). The three housing members 1310*a*, 1310*b* and 1310*c* provide additional stability to the configuration during the massaging event. The three housing members 1310*a*, 1310*b* and 1310*c* may be enclosed such that, the housing member 1310*a* may engage the unitary massaging implements 1604*a* and 1604*b*, the housing member 1310*b* may engage the unitary massaging implements 1604*a*, 1604*b* and 1604*c*, and the housing member 1310*c* may engage the unitary massaging implements 1604*b* and 1604*c* (for e.g. as shown in FIG. 16).

Figure 17:
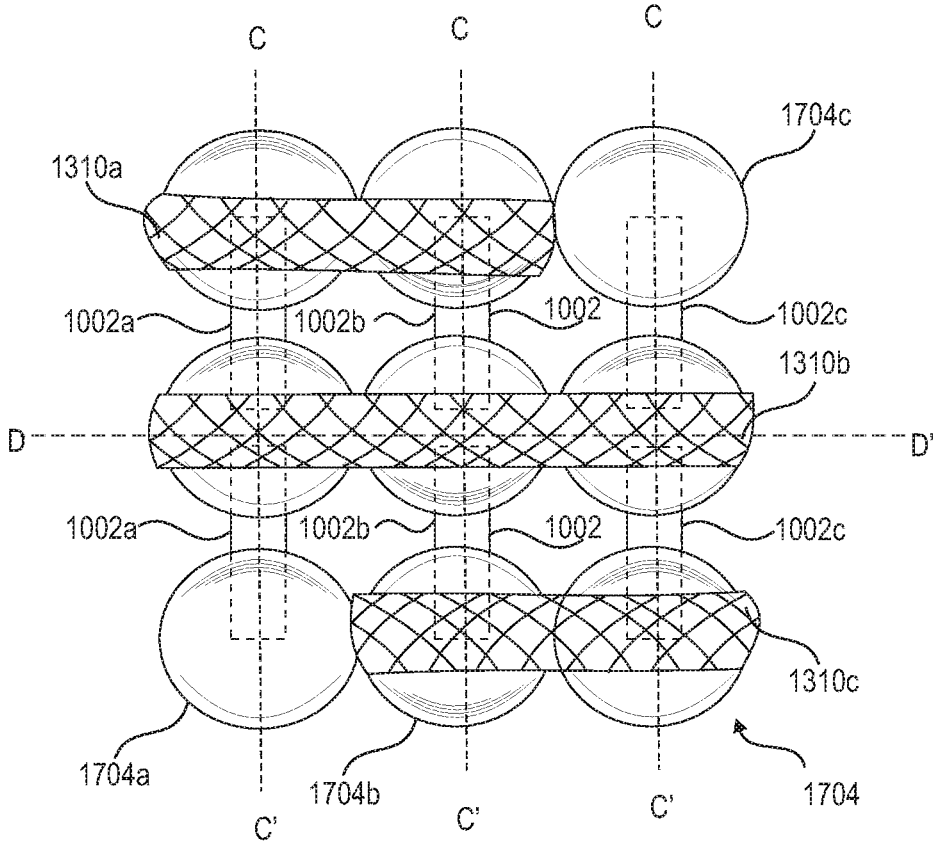
FIG. 17 is a schematic view of at least three unitary massaging implements enclosed in the housing member, in accordance with another embodiment of the present disclosure.

In another embodiment, the unitary massaging implements 1704 may include three massaging implements 1704*a*, 1704*b* and 1704*c* in the abutting configuration, collectively illustrated as the unitary massaging implements 1704 in FIG. 17. The unitary massaging implements 1704 may be made or assembled by connecting three massaging implements, by the connecting members 1002 as already described above. In an embodiment, the housing member 1310 may include three housing members 1310*a*, 1310*b* and 1310*c*, for enclosing three unitary massaging implements 1704 (for e.g. as shown in FIG. 17). Each of the three unitary massaging implements 1704*a*, 1704*b* and 1704*c* may be formed by connecting the three massaging implements via the connecting members 1002*a*, 1002*b* and 1002*c*]. The three housing members 1310*a*, 1310*b* and 1310*c* may be enclosed such that, the housing member 1310*a* may engage the unitary massaging implements 1704*a* and 1704*b*, the housing member 1310*b* may engage the unitary massaging implements 1704*a*, 1704*b* and 1704*c*, and the housing member 1310*c* may engage the unitary massaging implements 1704*b* and 1704*c* (for e.g. as shown in FIG. 17). The combination of the connecting members 1002*a*, 1002*b* and 1002*c* employed for the unitary massaging implement 1704 may be selected as per feasibility and requirement. In an embodiment, the connecting members 1002*a*, 1002*b* and 1002*c* may be selected to be tubular configurations for connecting the three massaging implements (for e.g. as shown in FIG. 17). In an embodiment, a combination of tubular configuration and the binding configuration of the connecting member 1002 may be employed for connecting the three massaging implements (not shown in Figures).

Figure 18:
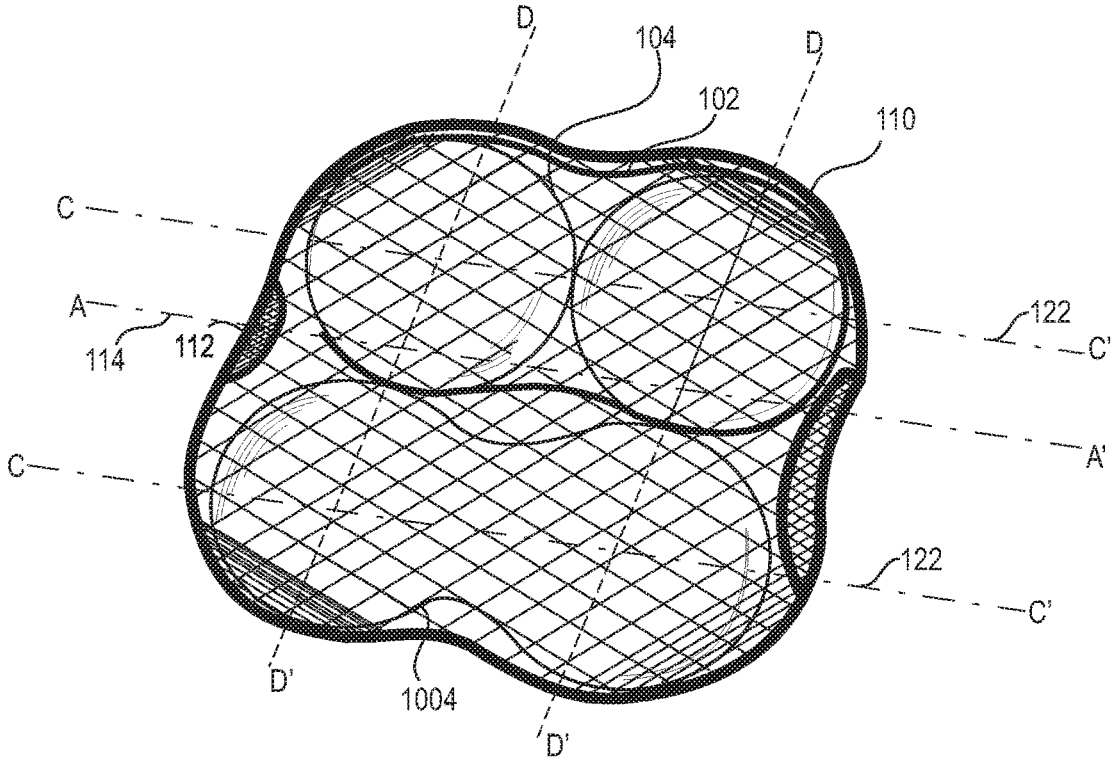
FIG. 18 is a schematic view of the housing member enclosing the combination of the sleeve member and one of the unitary massaging implements, in accordance with an embodiment of the present disclosure.
Figure 19:
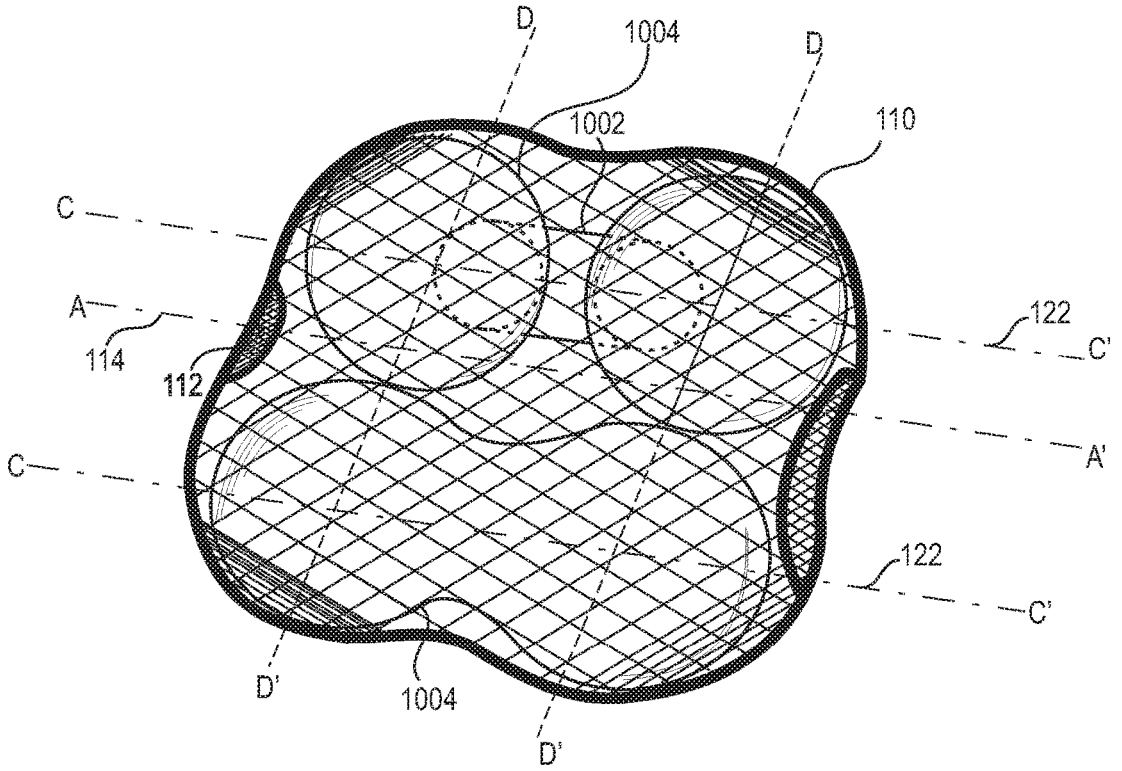
FIG. 19 is a schematic view of the housing member enclosing at least two unitary massaging implements, in accordance with another embodiment of the present disclosure.
Figure 20:
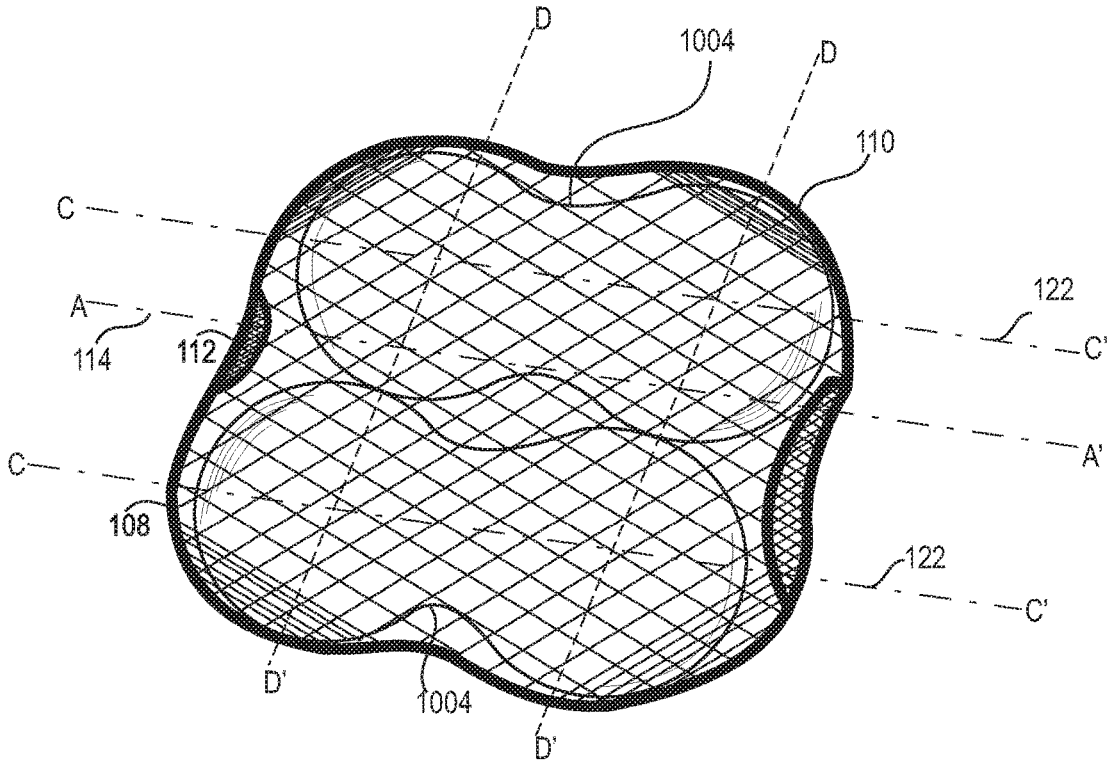
FIG. 20 is a schematic view of the housing member enclosing at least two unitary massaging implements, in accordance with another embodiment of the present disclosure.

In an embodiment, the housing member 110 encloses two or more unitary massaging implements 1004, at least one of which may comprise sleeve member 102, wherein each of said sleeve member 102 encloses massaging implements 104 (as shown in FIG. 18), wherein each sleeve member 102 and each of the unitary massaging implement 1004 may be accessed via the aperture 112 for either withdrawal from or insertion into the housing member 110. In an embodiment, the housing member 110 may also enclose a reniform or peanut-shaped unitary massaging implement 1004 and the unitary massaging implement 1004 assembled by the connecting member 1002 (as shown in FIG. 19). In an embodiment, the housing member 110 may also enclose the unitary massaging implements 1004 comprising peanut-shaped configurations (as shown in FIG. 20), each of which may be withdrawn or inserted into housing member 110 via aperture 112.

In an embodiment, the housing member 1310 may include embodiments included for the housing member 110.

In an embodiment, the housing member 1310 may comprise elastic material, for accommodating the plurality of massaging implements 804.

Various example embodiments of the present disclosure offer following advantages. For instance, the present disclosure provides a massaging device, which provides a stable platform to the user during the massaging event, thereby preventing the need for manual intervention from the user for adjusting position of the massaging device. Further, the present disclosure provides the massaging device which exhibits high degree of modularity by allowing the user to alter configuration of the device as per feasibility and requirement. Moreover, the present disclosure provides the massaging device which may be configured to render lumbar support or for massaging of any suitable body part of the user.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims.

What is claimed is:

1. A massaging device, comprising:

a plurality of massaging implements;

a plurality of sleeve members adapted to encompass the plurality of massaging implements, wherein each of the plurality of sleeve members is adapted to enclose at least two massaging implements of the plurality of massaging implements in an abutting configuration; and a housing member configured to engage a massaging area on a user and adapted to enclose each of the plurality of sleeve members, wherein each of the plurality of sleeve members is aligned along an internal axis of the housing member, such that, the plurality of massaging implements are adapted to roll along a direction perpendicular to the internal axis and resist rolling along the direction of the internal axis upon application of a force on the housing member during a massaging event on the massaging area.

2. The massaging device as claimed in claim 1, wherein each sleeve member of the plurality of sleeve members includes an open end for receiving the plurality of massaging implements and a closed end for retaining the plurality of massaging implements therein.

3. The massaging device as claimed in claim 1, wherein one massaging implement of the at least two massaging implements contacts with another massaging implement of the at least two massaging implements within each of the plurality of sleeve members to form the abutting configuration.

4. The massaging device as claimed in claim 1, wherein the at least two massaging implements in each sleeve member of the plurality of sleeve members align parallelly along a longitudinal axis of each sleeve member of the plurality of sleeve members.

5. The massaging device as claimed in claim 1, wherein the housing member includes at least one aperture for receiving the plurality of sleeve members.

6. The massaging device as claimed in claim 5, wherein the internal axis is an axis of the housing member parallel to an axial plane of one of the at least one aperture.

7. The massaging device as claimed in claim 1, wherein each sleeve member of the plurality of sleeve members is aligned parallelly along the internal axis of the housing member, to form either of a two-dimensional configuration or a three-dimensional configuration of the plurality of massaging implements.

8. The massaging device as claimed in claim 1, wherein the housing member and the plurality of sleeve members comprise of a flexible fabric material.

9. The massaging device as claimed in claim 1, wherein the plurality of massaging implements comprises a plurality of spherical massaging implements, comprising a flexible material.

10. The massaging device as claimed in claim 1, wherein a boundary surface of the plurality of massaging implements project outwardly from the housing member as a protrusion, for accessing each of the plurality of massaging implements for dismantling the massaging device.

11. The massaging device as claimed in claim 1, wherein the housing member includes at least one adjustable strap member mountable on a seat member, for configuring the massaging device as a lumbar support device.

12. The massaging device as claimed in claim 1, further comprising at least one adjustable strap member extending from the housing member, the at least one adjustable strap member is mountable on a back-rest member of a seat for providing lumbar support to a user resting on the back-rest member.

13. A massaging device, comprising:

a plurality of spherical massaging implements comprised of a flexible material;

a plurality of sleeve members adapted to encompass the plurality of spherical massaging implements, wherein each of the plurality of sleeve members is adapted to enclose at least two spherical massaging implements of the plurality of spherical massaging implements in an abutting configuration, each sleeve member of the plurality of sleeve members including an open end for receiving the plurality of spherical massaging implements and a closed end for retaining the plurality of spherical massaging implements therein; and a housing member configured to engage a massaging area on a user and including at least one aperture for receiving each of the plurality of sleeve members, the housing member adapted to enclose the plurality of spherical massaging implements encompassed within the plurality of sleeve members, wherein each sleeve member of the plurality of sleeve members is aligned along an internal axis of the housing member, such that, the plurality of spherical massaging implements in the plurality of sleeve members are adapted to roll along a direction perpendicular to the internal axis and resist rolling along the direction of the internal axis upon application of a force on the housing member during a massaging event on the massaging area.

* * * * *